United States Patent [19]

Newby

[11] 4,235,370

[45] Nov. 25, 1980

[54] PORTABLE SET-OFF DEVICE FOR RAILROAD MOTORCARS

[76] Inventor: Kenneth D. Newby, P.O. Box 441, Moorcroft, Wyo. 82721

[21] Appl. No.: 14,096

[22] Filed: Feb. 22, 1979

[51] Int. Cl.[2] ..... E01B 23/00

[52] U.S. Cl. ..... 238/10 R; 14/69.5

[58] Field of Search ..... 14/69.5, 71.1; 105/177, 105/215 C; 104/263; 238/6, 10, 11

[56] References Cited

U.S. PATENT DOCUMENTS

| | | | |
|---|---|---|---|
| 367,260 | 7/1887 | Arcus | 104/263 |
| 1,246,921 | 11/1917 | Holt | 105/215 C X |
| 1,351,972 | 9/1920 | Stewart | 105/215 C |
| 1,384,114 | 7/1921 | Arnold | 14/69.5 |
| 1,926,695 | 9/1933 | Hutton | 105/215C |
| 2,009,113 | 7/1935 | Landis | 105/177 |
| 2,117,077 | 5/1938 | Bernard | 105/177 |
| 2,150,348 | 3/1939 | Strauss | 105/215 C |
| 2,155,790 | 4/1939 | Cougar | 105/177 X |
| 2,157,650 | 5/1939 | Fildes | 105/215 C |
| 2,162,351 | 6/1939 | Main | 105/215 C |
| 2,487,572 | 11/1949 | McKee | 105/177 X |
| 2,614,755 | 10/1952 | Binaut | 14/69.5X |
| 2,726,743 | 12/1955 | Short | 14/69.5 X |
| 3,182,604 | 5/1965 | Foxx | 105/177 |
| 3,412,691 | 11/1968 | Mueller | 105/177 |

*Primary Examiner*—Nile C. Byers, Jr.
*Attorney, Agent, or Firm*—Wigman & Cohen

[57] ABSTRACT

A portable set-off device for a railroad motorcar comprises a collapsible platform and a telescoping ramp. The platform has a barrier, near its end edges transverse to the railroad tracks, for preventing the wheels of the motorcar from rolling off the end edge of the platform. The platform also has an inclined ramp along the same end edges for permitting a wheel of the motorcar to be rolled back up onto the platform in the event that the motorcar has rolled off into the space between the railroad track rails. The platform may be divided longitudinally into two half-parts which have the inclined ramp along the same end edges for permitting rubber wheels of a high-rail motor vehicle to drive up onto the railroad track rails.

24 Claims, 11 Drawing Figures

FIG. 10
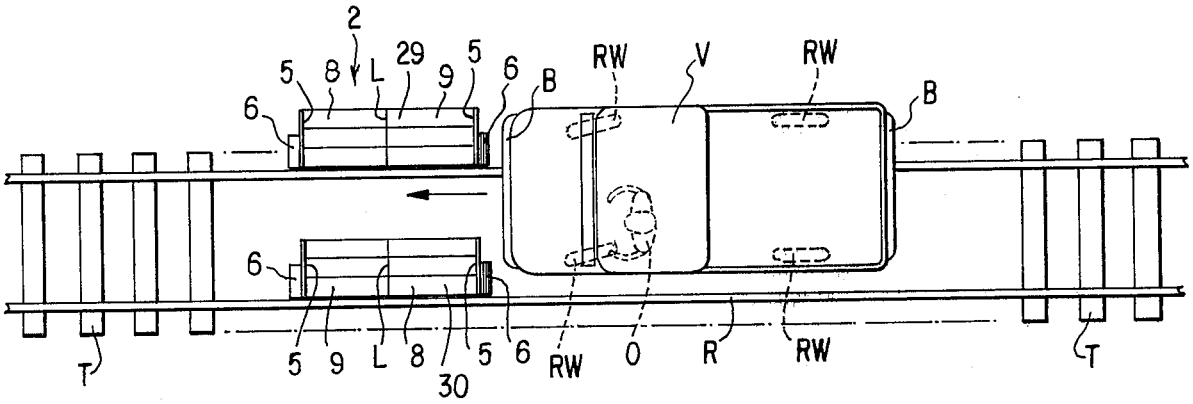
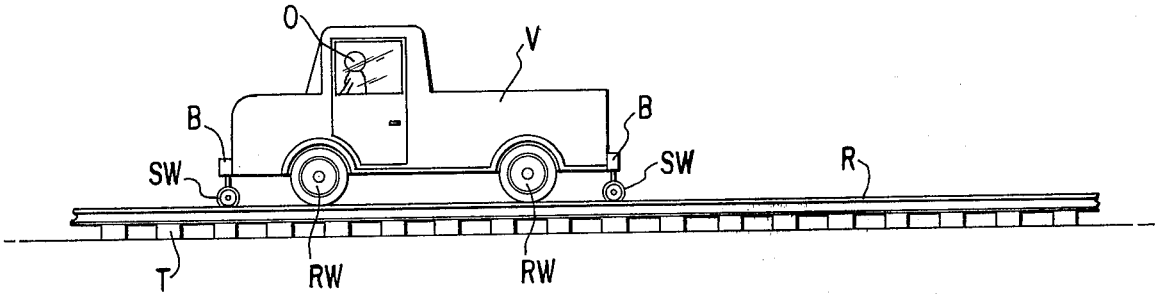
FIG. 11

PORTABLE SET-OFF DEVICE FOR RAILROAD MOTORCARS

BACKGROUND OF THE INVENTION

1. Field of the Invention

This invention relates to railway rolling stock, in particular to a trackman's car carrying a portable set-off device.

2. Description of the Prior Art

As the railroads are modernizing and the maintenance of tracks is increasing, small but necessary items, such as permanent set-off devices for motorcars, are becoming obsolete. However, there remains a need in the railroad industry for a portable set-off device that is easy to handle and store. Portable set-off devices are beginning to replace the permanent set-off devices now utilized throughout the industry.

The main disadvantage of the permanent set-off device, which is affixed to the railroad ties between the iron rails at predetermined distances from each other, is that a motorcar, if traveling upon the same track on which a train is also heading in the opposite direction, must reach the permanent set-off device and be removed from the railroad track before the oncoming train reaches the same position. Thus, this method of operating a railroad sometimes presents trackmen with a dangerous situation.

Although portable set-off devices are known in the railroad industry, they have not met with complete acceptance because they do not provide an easy and quick way for removing the motorcar from the railroad tracks. Such exemplary prior art portable set-off devices are shown and described in U.S. Pat. Nos. 367,260, 1,351,972, and 3,182,604.

Thus, it is still a problem in the railroading industry to provide a portable set-off device which is easy to handle, quick to use, light weight, and ready to be stored in an unobtrusive but convenient place on the motorcar.

SUMMARY OF THE INVENTION

It is a primary object of the present invention to provide a portable set-off device for a railroad motorcar which is easy to handle, quick to use, light weight, and convenient to store when not in use.

It is an additional object of the present invention to provide a portable set-off device with a collapsible platform and a telescoping ramp.

It is a further object of the present invention to provide the collapsible platform of the railroad motorcar with a barrier, near to the end edges transverse to the railroad tracks, for preventing the wheels of the motorcar from rolling off the end edge of the platform when the motorcar is being removed from the railroad tracks and being turned for running down the telescoping ramp of the portable set-off device.

It is another object of the present invention to provide the platform of the portable set-off device with an inclined ramp along the same end edges in order to permit a wheel of the motorcar to be rolled back up onto the platform in the event that the motorcar has somehow rolled off the platform and into the space between the railroad track rails.

It is another object of the present invention to manufacture the collapsible platform so that it is foldable along a hinge located approximately along the center line of the platform transverse to the railroad track rails.

It is an additional object of the present invention to provide a cross rod extending transversely between the two legs of the telescoping ramp. This cross rod has a first section and a second section, both of which extend perpendicular to the two legs of the telescoping ramp and are joined to each other by a union or other joining means.

It is an additional object of the present invention to manufacture the collapsible platform so that it is divided longitudinally into two half-parts. Each half-part has an inclined ramp for permitting rubber wheels of a high-rail motor vehicle to drive up onto the railroad track rails.

BRIEF DESCRIPTION OF THE DRAWINGS

FIG. 10 is a top plan view of a high-rail motor vehicle about to be driven up the two longitudinal half-parts of the platform onto the railroad track rails; and FIG. 11 is a side elevational view of the high-rail motor vehicle on the railroad track rails after traversing the two longitudinal half-parts of the platform portion shown in FIG. 10.

DETAILED DESCRIPTION OF THE PREFERRED EMBODIMENTS

Figure 1:
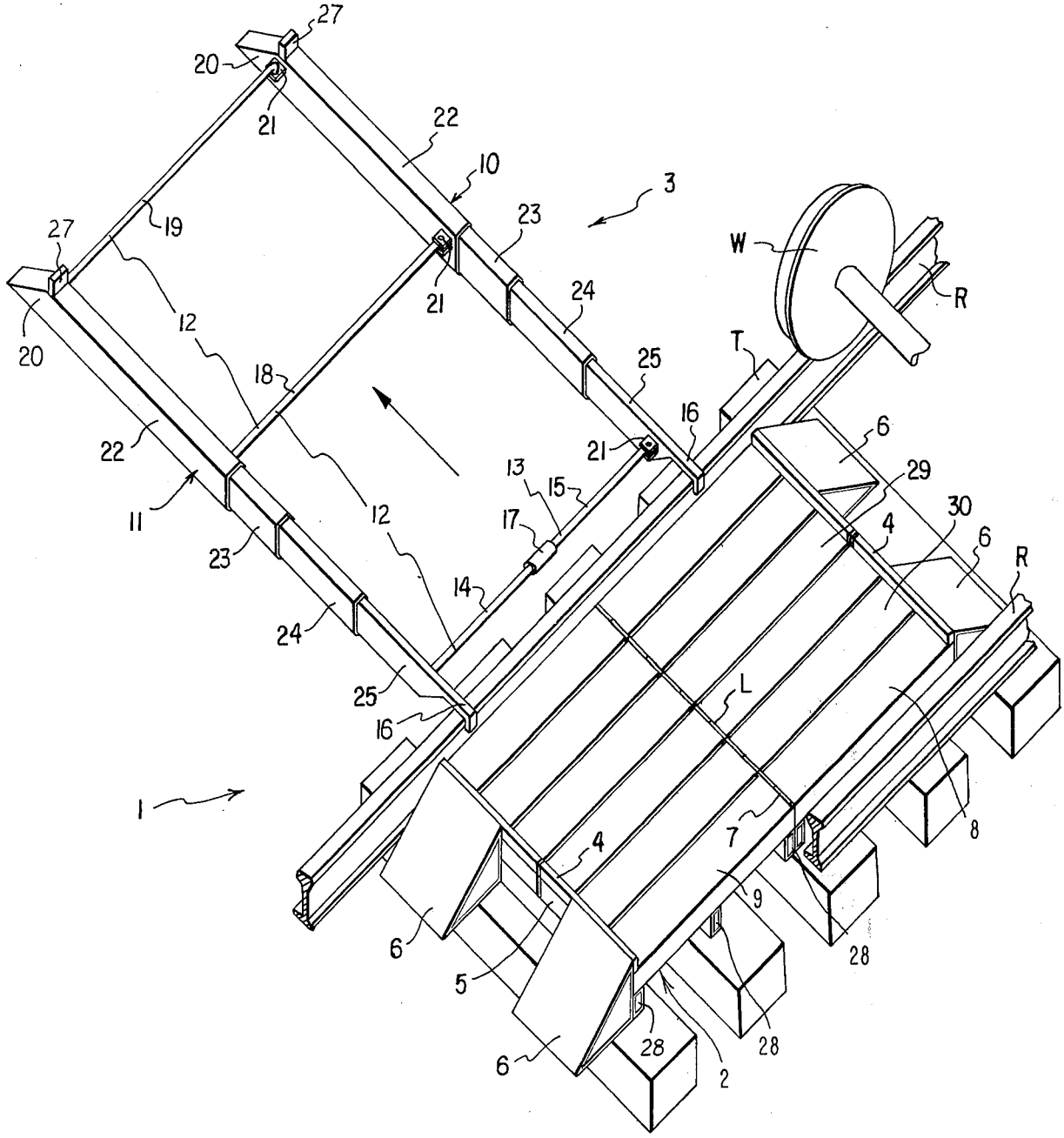
FIG. 1 is an isometric view of the portable set-off device for a motorcar traveling on railroad tracks.

In FIG. 1 of the drawings, an isometric view of the portable set-off device in its laid-out position is shown. The set-off device has a collapsible platform 2 and a partially telescoping ramp 3. The collapsible platform 2 has a barrier 4 near to its end edges 5 which are transverse to the track rails R of the railroad track T. The collapsible platform 2 also is divided longitudinally into two half-parts 29 and 30, each of which has an inclined ramp 6 along the same end edges 5.

Figure 4:
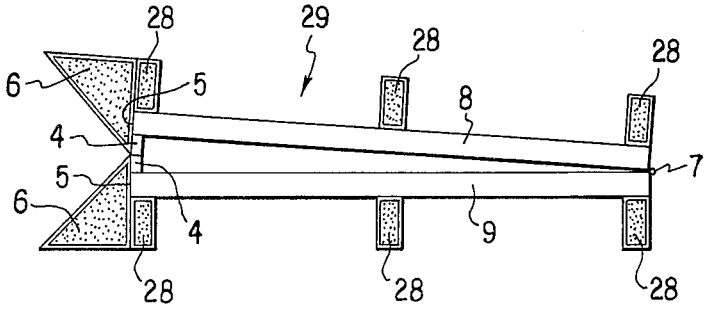
FIG. 4 is a side elevational view of a first embodiment of a foldable platform of the portable set-off device in its folded position.
Figure 5:
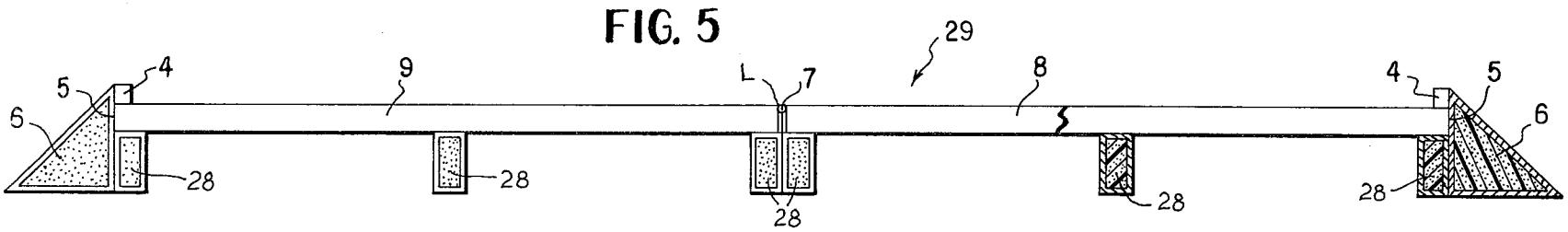
FIG. 5 is a side elevational view of the first embodiment of the foldable platform of the portable set-off device in its unfolded laid-out position.

In one preferred embodiment of the present invention illustrated in FIGS. 4 and 5, the half-part 29 is foldable along a hinge 7 which is located approximately along the center line L of the collapsible platform 2. The center line L of the collapsible platform 2 is transverse to the track rails R of the railroad track T. The center line L divides the platform 2 laterally into two half sections 8 and 9.

Figure 6:
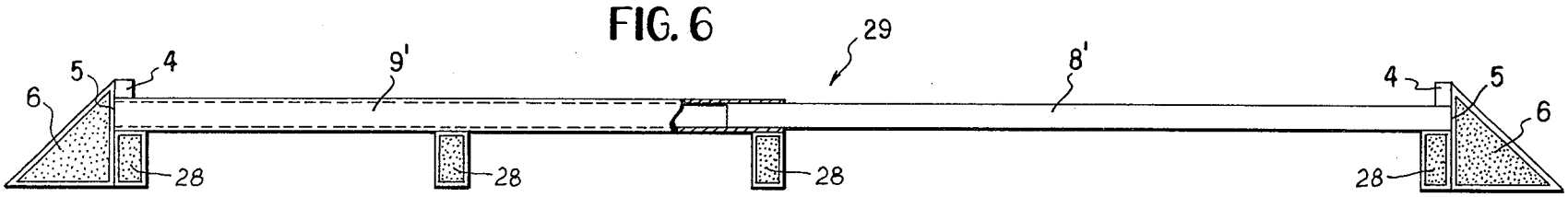
FIG. 6 is a side elevational view of a second embodiment of a telescoping platform of the portable set-off device in its telescoped, laid-out position.
Figure 7:
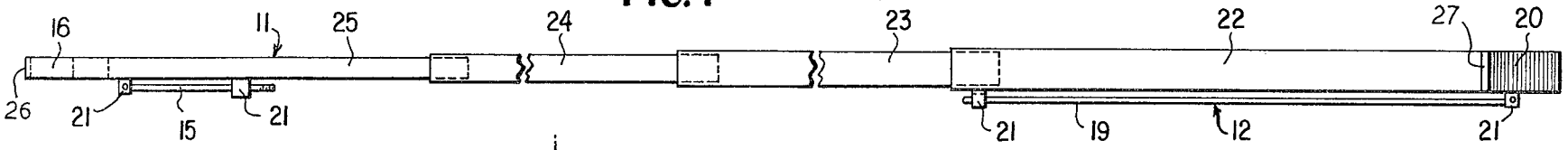
FIG. 7 is a top view of a leg of a telescoping ramp of the portable set-off device in its telescoped, fully extended position.

In another preferred embodiment of the collapsible platform 2 illustrated in FIG. 6, the half-part 29 of the platform 2 is divided laterally into two telescoping half sections 8' and 9'. Lateral half section 8' telescopes into lateral half section 9' for easy storage when the set-off device 1 is not in use.

Referring back to FIGS. 2 and 3, the telescoping ramp 3 includes two legs 10 and 11 which extend parallel to each other and perpendicular to the track rails R of the railroad track T. These two legs 10 and 11 include connection means 12 for spacing the two legs 10 and 11 apart. The connection means 12 includes a first cross rod 13 which extends transversely between the two legs 10 and 11. This first cross rod 13 includes a first section 14 and a second section 15. Preferably, the first section 14 and the second section 15 are half sections and are fixed to the first leg 10 and the second leg 11, respectively, at the end 16 of the telescoping ramp 3 which is closer to the track rails R of the railroad track T. The first section 14 and the second section 15 of the first cross rod 13 extend perpendicularly to the two legs 10 and 11 and are joined to each other by a union 17 which may be a bolt or other joining means.

As may be best seen in FIG. 1, the connection means 12 also includes a second cross rod 18 extending transversely from the first leg 10 to the second leg 11. The connection means 12 also includes a third cross rod 19 which extends transversely from the second leg 11 to the first leg 10. Both the second cross rod 18 and the third cross rod 19 extend parallel to each other and are perpendicular to the two legs 10 and 11. As may be seen in FIGS. 2 and 3, the second cross rod 18 and the third cross rod 19 are fixed to the two legs 10 and 11 at the end 20 of the telescoping ramp 3 which is farther from the track rails R of the railroad track T.

As may be best seen in FIG. 1 of the drawings, the portable set-off device 1 also comprises fixtures 21 for fixing the first cross rod 13, the second cross rod 18, and the third cross rod 19 to the two legs 10 and 11 of the telescoping ramp 3.

Figure 8:
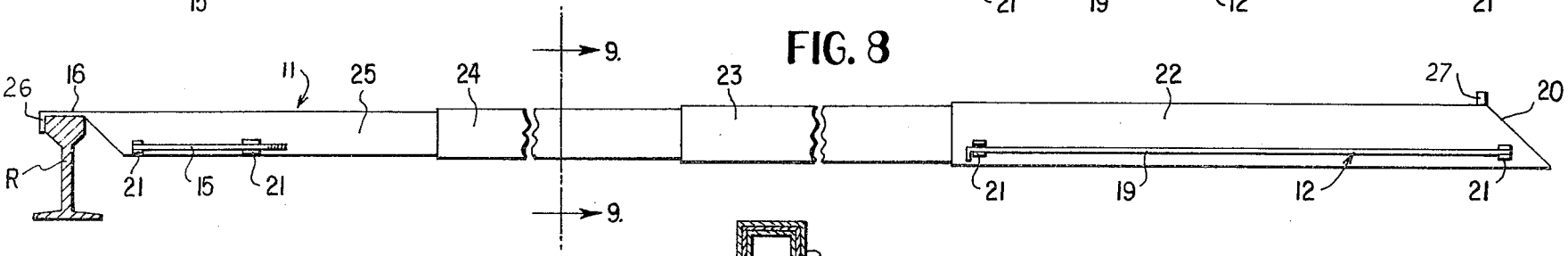
FIG. 8 is a side view of a leg of the telescoping ramp of the portable set-off device in its telescoped, fully extended position.
Figure 9:
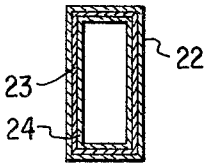
FIG. 9 is a cross-sectional view taken along line 9—9 of FIG. 8 and shows one leg of the telescoping ramp of the portable set-off device.

FIG. 9 shows a cross sectional view of leg 11 taken through line 9—9 of FIG. 8. As may be readily seen, the telescoping ramp 3 may be multi-sectional. In the particular illustrated embodiment, leg 11 consists of four telescoping sections. Telescoping section 22 is the largest section of the ramp 3. There is a first intermediate telescoping section 23 and a second intermediate telescoping section 24. Section 25 of the ramp 3 is the smallest section but the fixtures 21 prevent section 25 from telescoping fully into the second intermediate section 24. At the end 16 of the smallest section 25 of the ramp 3, there is a hook 26 or other means for hanging leg 11 over the track rail R of the railroad track T.

The materials preferred in manufacturing the portable set-off device 1 are wood, aluminum, or light weight plastics for both the collapsible platform 2 and the telescoping ramp 3. As may be seen in FIG. 5 of the drawings, the inclined ramp 6 and cross braces 28 may, alternately, be made of fiberglass skin filled with urethane foam or, as in FIG. 6, filled with other plastic material.

The portable set-off device 1 is used in the following manner. Device 1 is usually transported either inside of or under the carriage of a covered motorcar M. When it is necessary for the operator O to move the motorcar M from the railroad track T for any reason, such as the approach of an oncoming train, the operator O lays out the platform 2 of the portable set-off device 1, in the manner illustrated in FIG. 1 of the drawings, so that the cross braces 28 rest upon railroad track ties T.

Figure 2:
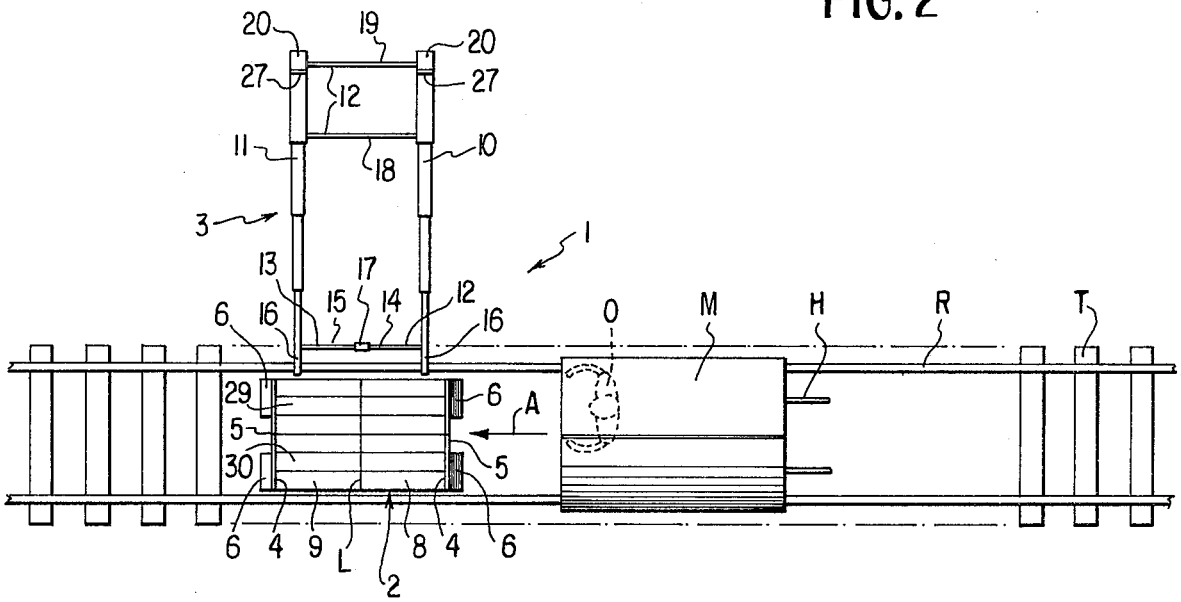
FIG. 2 is a top plan view of a covered motorcar traveling on the railroad tracks and approaching the portable set-off device.
Figure 3:
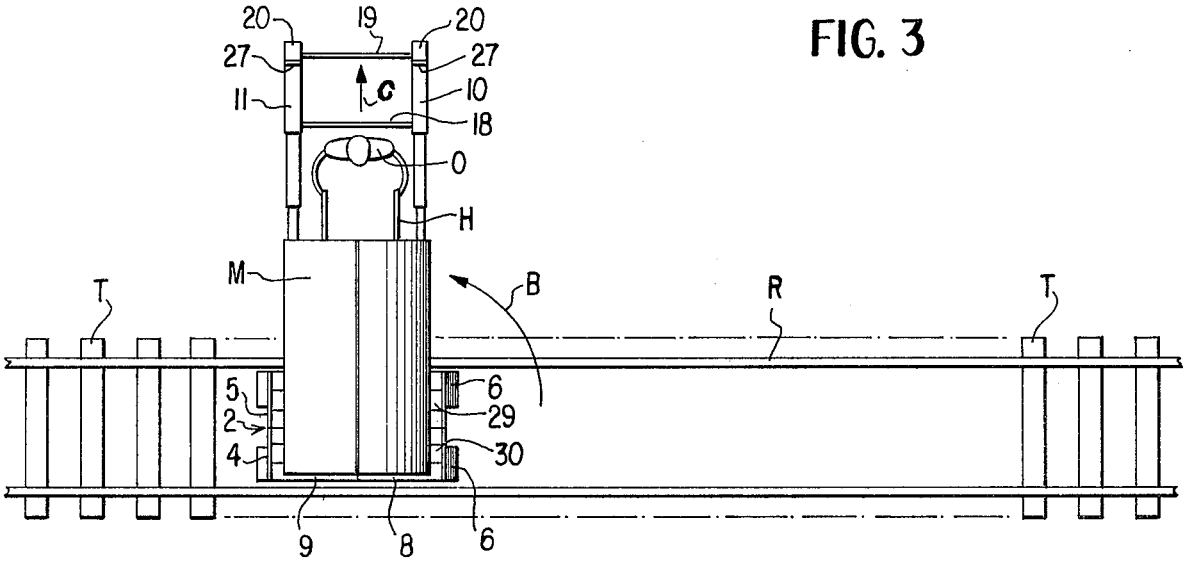
FIG. 3 is a top plan view of the covered motorcar resting on the platform and being directed down the telescoping ramp.

As may be further seen in FIG. 2, the operator O returns to the motorcar M and drives in the direction of the arrow A partially over the platform 2 of the portable set-off device 1. Thereafter, the operator O gets out of the motorcar M and telescopes out the ramp 3 and hangs near ends 16 over the track rails R. One end 16 is hung slightly in front of the front wheels W while the other end 16 is hung behind the front wheels W. The operator O lifts the rear wheels W from the track rails R and turns the motorcar M at a 90° angle as is indicated by the arrow B in FIG. 3. The front wheels W of the motorcar M are now also removed from the track rails R onto the platform 2 and are in a position to be guided down the telescoped ramp 3 of the set-off device 1. In FIG. 3, the operator O is shown setting the rear wheels W of the motorcar M down on the ramp 3. In order to prevent the front wheels W from rolling off the end edges 5 of the platform 2, a barrier 4 is provided near the end edges 5 of the platform 2. In the unlikely event that the front wheels W may have rolled off the platform 2 and come to rest between the track rails R or the railroad track ties T inclined, ramps 6 are provided along the end edges 5 of the platform 2 for permitting the front wheels W of the motorcar M to be rolled back up onto the platform 2.

In FIG. 3, the operator O then walks around to the front of the motorcar M and pushes it so that the motorcar M is guided in the direction of arrow C down the telescoped ramp 3. The connection means 12 space the two legs 10 and 11 of the ramp 3 sufficiently far apart in order to support the wheels W of the motorcar M. Once the rear wheels W in FIG. 3 contact the stops 27 at the far end 20 of the ramp 3, the operator O lifts and telescopes the ramp 3 slightly inward at the near end 16 away from overhanging the rails R so that the oncoming train may pass over the rails R without incident. Since the platform 2 of the portable set-off device 1 is narrower than the spacing between the track rails R, it is unnecessary for the operator O to remove the platform 2 from the railroad track ties T during the passage of the oncoming train.

After the oncoming train has passed, the operator O puts the motorcar M back onto the track rails R by reversing the direction for removing the motorcar M therefrom. Once the motorcar M is back onto the track rails R, the operator O may telescope the sections 22, 23, and 24 of the ramp 3 together and disconnect the connection means 12 from the two legs 10 and 11 for storage purposes. The half-parts 29 and 30 of the platform 2 may then be folded, as half-part 29 is shown in FIG. 4 of the drawings or telescoped together as it is shown in FIG. 6 of the drawings, for storage purposes also. The operator O in his motorcar M may then proceed down the railroad tracks along his merry way.

In FIGS. 10 and 11, an alternate use for the half-parts 29 and 30 of the platform 2 is shown. When a so-called high-rail motor vehicle V, such as a pick-up truck, is derailed along the rails R, the half-parts 29 and 30 of the platform 2 are separated and laid out parallel to the rails R. One half-part 29 may be turned around and laid on the outside of one track rail R while the other half-part 30 may be laid on the inside of the other track rail R. Thus, the side ramps 6 will extend alongside the track rails R in order to facilitate rerailing of the vehicle V. In FIG. 10, the operator O is shown about to drive the derailed vehicle V up the inclined ramp 6, over the barrier 5 and onto the lateral half sections 8 and 9. When the front rubber wheels RW of vehicle V reach the center line L, the platform 2 is prevented from folding upwardly by the central cross braces 28 which rest upon the railroad track ties T. See FIG. 5. The operator O thereafter drives the vehicle V up onto the railroad tracks. As shown in FIG. 11, the small railroad wheels SW, lowered from the bumper B of the vehicle V, are moved into contact with the rails R. These small railroad wheels SW cause the rubber wheels RW of the vehicle V to remain in contact with the railroad tracks during the travel of the vehicle V down the railroad tracks.

The foregoing preferred embodiments are considered as illustrative only. Numerous other modifications and changes will readily occur to those skilled in the art of railroading and, consequently, the disclosed invention is not limited to the exact constructions and operations shown and described hereinabove.

I claim:

1. A portable set-off device for a railroad motorcar comprising:

a. a collapsible platform for placement in the space between the railroad track rails, said collapsible platform having end edges;

b. a telescoping ramp for placement beside and substantially perpendicular to the railroad track rails; and c. inclined ramp means, mounted on the end edges of said collapsible platform, for permitting a wheel of the motorcar to be rolled back up onto the platform in the event that the motorcar has rolled off into the space between the railroad track rails, said inclined ramp means being oriented substantially parallel to the railroad track rails in the space therebetween and along the end edges of the collapsible platform, said end edges being transverse to the railroad track rails.

2. A portable set-off device for a railroad motorcar, according to claim 1, wherein said collapsible platform has a barrier means, near its end edges transverse to the railroad track rails, for preventing the wheels of the motorcar from rolling off said end edge of the platform.

3. A portable set-off device for a railroad motorcar, according to claim 1, wherein said collapsible platform is foldable.

4. A portable set-off device for a railroad motorcar, according to claim 3, wherein said collapsible platform is foldable along a hinge.

5. A portable set-off device for a railroad motorcar, according to claim 4, wherein said hinge is located approximately along the center line of the collapsible platform.

6. A portable set-off device for a railroad motorcar, according to claim 5, wherein said center line of the collapsible platform is transverse to the railroad track rails.

7. A portable set-off device for a railroad motorcar, according to claim 1, wherein said telescoping ramp includes two legs extending parallel to each other and substantially perpendicular to the railroad track rails.

8. A portable set-off device for a railroad motorcar, according to claim 7, wherein said two legs include connection means for spacing said two legs sufficiently apart so as to support the wheels of the railroad motorcar.

9. A portable set-off device for a railroad motorcar, according to claim 8, wherein said connection means includes a first cross rod extending transversely between said two legs.

10. A portable set-off device for a railroad motorcar, according to claim 9, wherein said first cross rod includes a first section and a second section.

11. A portable set-off device for a railroad motorcar, according to claim 10, wherein said first section and said second section of said first cross rod are fixed to a first leg and a second leg, respectively, of said two legs at the end of the telescoping ramp closer to the railroad track rails.

12. A portable set-off device for a railroad motorcar, according to claim 11, wherein said first and second sections of said first cross rod extend substantially perpendicular to said two legs and are joined to each other by a union means.

13. A portable set-off device for a railroad motorcar, according to claim 12, wherein said connection means includes a second cross rod extending transversely from the first leg of the two legs to the second leg of the two legs.

14. A portable set-off device for a railroad motorcar, according to claim 13, wherein said connection means includes a third cross rod extending transversely from the second leg of the two legs to the first leg of the two legs.

15. A portable set-off device for a railroad motorcar, according to claim 14, wherein said second and third cross rods extend substantially parallel to each other and substantially perpendicular to said two legs.

16. A portable set-off device for a railroad motorcar, according to claim 15, wherein said second and third cross rods are fixed to said two legs at the end of the telescoping ramp farther from the railroad track rails.

17. A portable set-off device for a railroad motorcar, according to claim 16, further comprising fixture means for fixing the first, second, and third cross rods to the two legs of the telescoping ramp.

18. A portable set-off device for a railroad motorcar, according to claim 1, wherein said collapsible platform is telescoping.

19. A portable set-off device for a railroad motorcar, according to claim 18, wherein said collapsible platform includes two half sections which telescope together.

20. A portable set-off device for a railroad motorcar, according to claim 7, wherein said two legs have means for stopping a wheel of the motorcar at the end of the telescoping ramp farther from the railroad track rails.

21. A portable set-off device for a railroad motorcar, according to claim 7, wherein said two legs have means for overhanging the railroad track rails at the end of the telescoping ramp closer to the railroad track rails.

22. A portable set-off device for a railroad motorcar, according to claim 1, wherein said collapsible platform is divided longitudinally into two half-parts.

23. A portable set-off device for a railroad motorcar, according to claim 22, wherein said two half-parts include the inclined ramp means for permitting rubber wheels of a high-rail motor vehicle to drive up onto the railroad track rails.

24. A portable set-off device for a railroad motorcar, according to claim 23, wherein said two half-parts each have cross brace means, located approximately along a center line of said collapsible platform so as to rest upon the railroad track ties, for preventing said platform from folding upwardly when the rubber wheels of the high-rail motor vehicle are driven thereover.

* * * * *